United States Patent [19]

Governale

[11] 4,095,310

[45] Jun. 20, 1978

[54] GUIDE AND PIVOT PIN CARTRIDGE ASSEMBLIES FOR FOLDING DOORS

[75] Inventor: Bernard C. Governale, Duluth, Ga.

[73] Assignee: Peachtree Doors, Inc., Atlanta, Ga.

[21] Appl. No.: 817,844

[22] Filed: Jul. 21, 1977

[51] Int. Cl.[2] ..... E05D 13/02

[52] U.S. Cl. ..... 16/87 R; 160/118; 160/206

[58] Field of Search ..... 16/87 R, 87 B, 87.2, 16/94 R, 96 A; 160/118, 199, 206; 248/221.3, 222.4; 24/221 R, 221 A; 403/348, 349, 166, 239, 329

[56] References Cited

U.S. PATENT DOCUMENTS

| | | | |
|---|---|---|---|
| 261,970 | 8/1882 | Tribou | 24/221 |
| 2,593,064 | 4/1952 | Silberman | 24/221 |
| 2,901,258 | 8/1959 | Brandafi | 403/349 |
| 3,019,836 | 2/1962 | Leigh | 160/199 |
| 3,278,145 | 10/1966 | Leshuk | 248/221.3 |
| 3,390,418 | 7/1968 | Sheridan | 160/206 |
| 3,431,537 | 3/1969 | Klingenberg | 24/221 |
| 3,568,263 | 3/1971 | Meehan | 24/221 |
| 3,588,020 | 6/1971 | Newcomer et al. | 248/251 X |
| 3,858,910 | 1/1975 | Oetirer | 403/349 |
| 3,866,658 | 2/1975 | Smith | 16/87 R X |

FOREIGN PATENT DOCUMENTS

| | | | |
|---|---|---|---|
| 1,067,570 | 8/1963 | United Kingdom | 403/348 |
| 525,355 | 8/1940 | United Kingdom | 403/348 |

*Primary Examiner*—Ronald Feldbaum
*Attorney, Agent, or Firm*—D. Paul Weaver

[57] ABSTRACT

Preassembled self-locking guide and pivot pin cartridge assemblies are installed on the job site in folding doors rather than on the factory assembly line. Considerable labor is saved in manufacturing and a better installation is achieved. Both the guide and pivot pin assemblies feature molded nylon housings which conveniently snap into place on the folding door brace structure. Top and bottom guide pin assemblies are identical and interchangeable. A lower adjustable pivot pin assembly possesses more than one and one-half inch of full threads on the molded nylon housing and includes a hardened steel lock clip having snap on engagement with the housing and threaded engagement with the adjustable screw-threaded pivot pin. A cooperating lock nut is provided to secure the assembly after proper adjustment. Both of the guide and pivot pin cartridge assemblies are insertable as units on the doors and can be removed if necessary.

5 Claims, 9 Drawing Figures

FIG.5
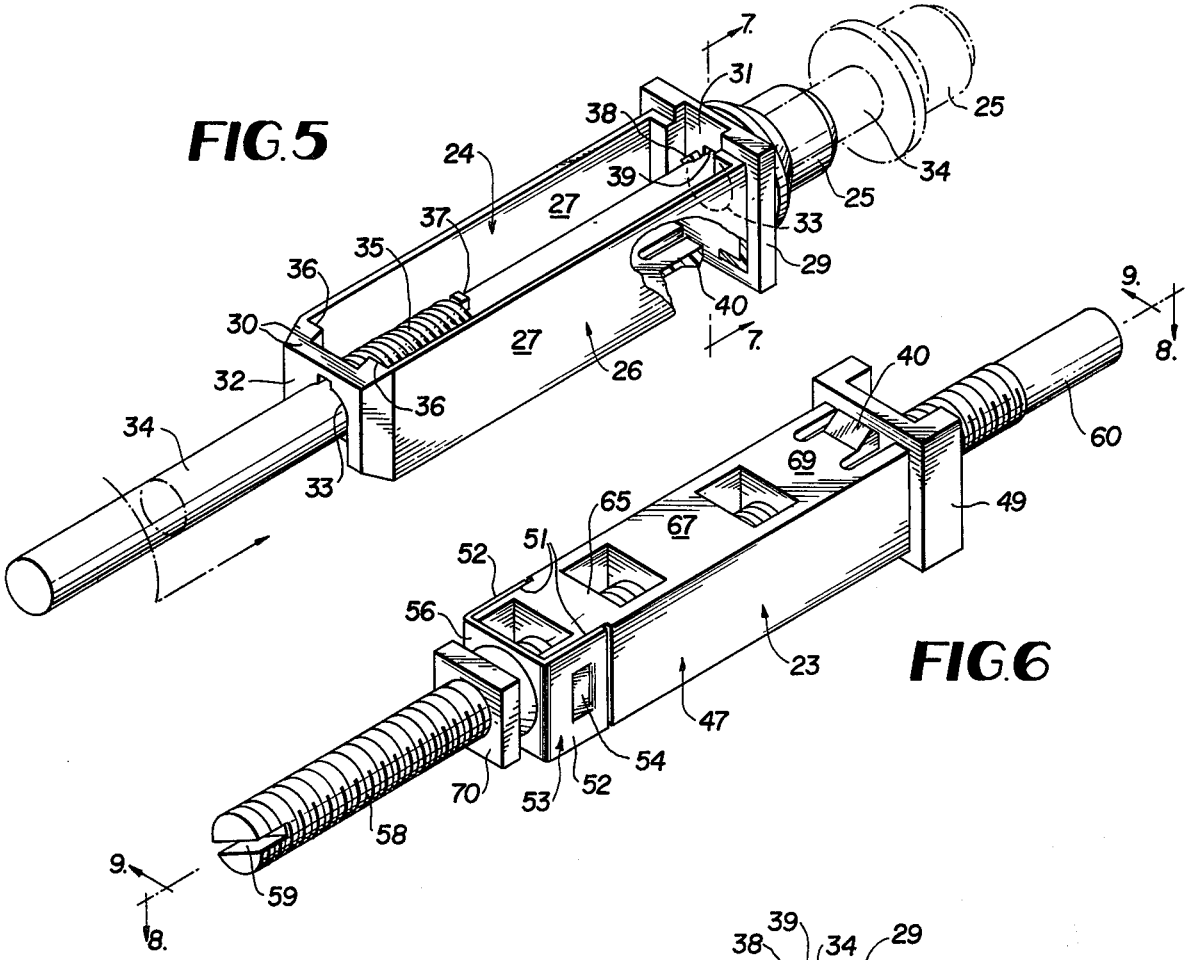
FIG.6
FIG.7
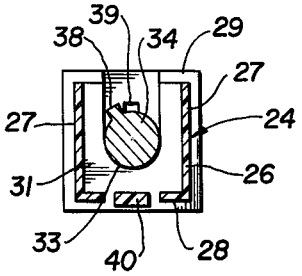
FIG.8
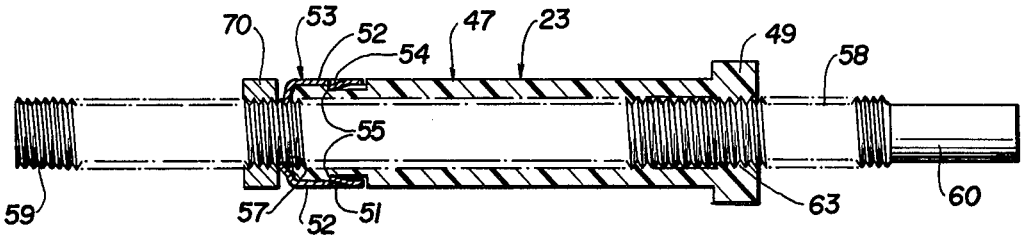
FIG.9
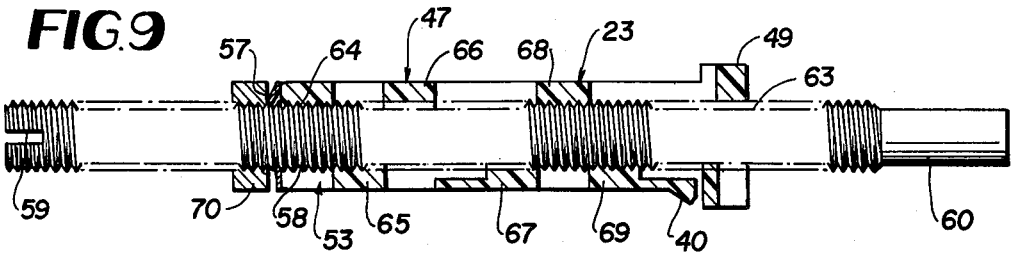

GUIDE AND PIVOT PIN CARTRIDGE ASSEMBLIES FOR FOLDING DOORS

BACKGROUND OF THE INVENTION

The present invention arises as a result of a constant need for more economical and more efficient and durable mounting hardware for folding doors. The major components of such mounting hardware comprise the top and bottom guide and pivot pin assemblies for the folding door sections.

In the prior art, it has been customary to install the guide and pivot pin assemblies on the door panels on the factory assembly line and prior to shipment to an installer. Some of the pin assemblies are made up of as many as seven individual parts and the labor cost of assembling on the production line has been considerable. Therefore, one of the prime objectives of this invention is to provide guide and pivot pin cartridge assemblies which are installed as units on the folding doors at the time of door installation. This procedure not only materially lessens manufacturing costs but also results in a superior door installation in view of the unitized nature of the pin assemblies and the convenient adjustability of the bottom pivot pin assemblies and their ability to remain locked in the required adjusted positions.

A further main object and feature of the invention is the provision of a greatly improved pin cartridge assembly, in terms of both guide pin and pivot pin assemblies, which include a sturdy and convenient molded nylon housing of rectangular cross section which can be snap locked into the brace structure of a folding door panel on the installation site with convenience by comparatively unskilled labor. Both the top and bottom guide pin assemblies have built in locking and release means for the spring-loaded guide pins which are released to their active door guiding positions by a simple twisting of the pins relative to the housing following insertion of the assembly as a unit into the door panel.

An additional and very major feature of the invention lies in the provision on each bottom pivot pin assembly of a hardened steel lock clip which has snap locking engagement with the upper end of the molded nylon housing and screw-threaded engagement with the adjustable threaded pivot pin element. This steel lock clip is also strategically positioned on the folding door panel to receive the side load from the brace structure and thereby relieve the nylon housing from directly receiving this load in a critical area. A separate locking nut cooperates with the lock clip to assure that the bottom pivot pin assembly will remain in the proper adjusted condition.

Other features and advantages of the invention will become apparent during the course of the following description.

Examples of known patented prior art devices along broadly similar lines are contained in the following U.S. Pat. Nos. 3,187,800, 3,160,201, 3,221,804, 3,368,236, 3,592,257, 3,866,658.

BRIEF DESCRIPTION OF THE DRAWINGS

FIG. 5 is a perspective view of a guide pin cartridge assembly.

FIG. 6 is a similar view of a bottom pivot pin cartridge assembly according to the invention.

FIG. 7 is a transverse vertical section taken on line 7—7 of FIG. 5.

FIG. 8 is a central longitudinal section taken on line 8—8 of FIG. 6.

FIG. 9 is a similar section taken on line 9—9 of FIG. 6.

DETAILED DESCRIPTION

Figure 1:
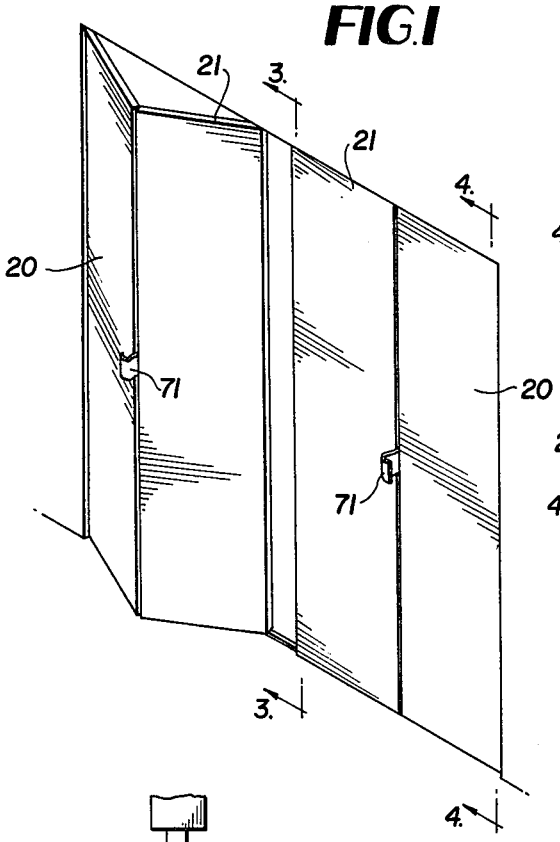
FIG. 1 is a partly schematic perspective view of folding doors equipped with the present invention.
Figure 2:
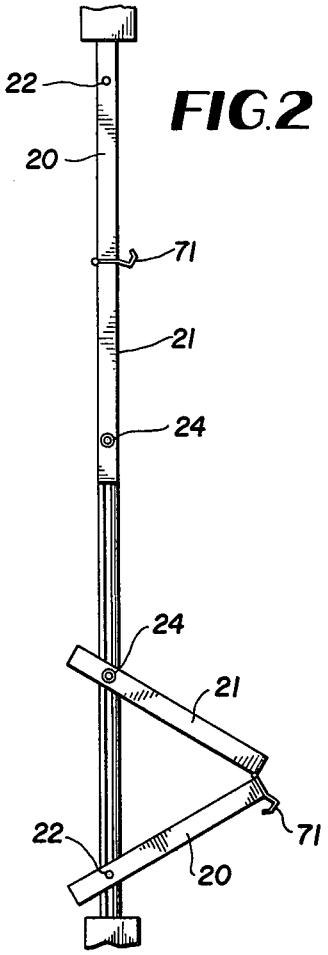
FIG. 2 is a partly schematic plan view of such doors.

Referring to the drawings in detail wherein like numerals designate like parts throughout, FIGS. 1 and 2 illustrate a pair of installed bifold doors each having hinged folding sections 20 and 21. Each folding door section 20 is pivotally mounted on top and bottom coaxial pivot pin cartridge assemblies 22 and 23 forming a part of the main subject matter of this invention. Similarly, each folding door section or panel 21 is provided at its top and bottom and near its free edge with a pair of identical guide pin cartridge assemblies 24 forming the remainder of the main subject matter of the invention.

Figure 4:
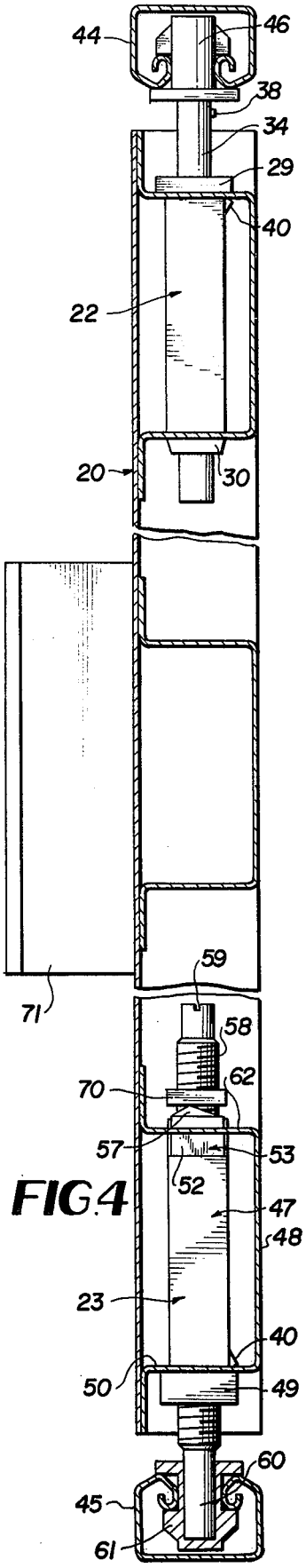
FIG. 4 is a similar section taken on line 4—4 of FIG. 1 and showing top and bottom pivot pin cartridge assemblies according to the invention.

It may be noted that the previously mentioned top pivot pin cartridge assembly 22 shown in FIGS. 2 and 4 is constructed identically to the guide pin assembly 24 except for the fact that the molded nylon cylindrical guide cap 25 of the assembly 24 is not utilized.

With particular reference to FIGS. 5 and 7, the guide pin cartridge assembly 24 is shown in detail and comprises an elongated rectangular cross section tough molded nylon housing 26 which has one side open between a pair of parallel side walls 27 and also includes a third side wall 28 at right angles to the walls 27. The housing 26 has a rectangular head 29 at one end and is tapered at its opposite end as shown at 30 in the drawings. The opposite end walls 31 and 32 of the housing 26 have coaxial circular apertures 33 formed therethrough for the sliding and rotatable reception of a rigid cylindrical folding door pivot pin 34 which has the aforementioned guide cap 25 fixedly secured to the end thereof adjacent the head 29. As previously noted, the upper pivot pin cartridge assembly 22 is identical to the assembly 24 minus the guide cap 25, so that the present description of the assembly 24 will serve as a description of the assembly 22.

A biasing expansion coil spring 35 is mounted on and surrounds pivot pin 34 in the housing 26, with one end of the spring bearing on end wall shoulders 36 and its opposite end bearing on and restrained by small radial stop lugs 37 on the pin 34. Another radial lug 38 projecting from the pin 34 near and inwardly of the cap 25 is adapted to pass through an opening 39 of like shape in the end wall 31, whereby the pin 34 and cap 25 can be releasably locked in the retracted spring-loaded state shown in FIG. 5 with the spring 35 tightly compressed between the lugs 37 and shoulders 36. This is accomplished by pushing on the cap 25 while holding the housing 26 and causing the lug 38 to pass inwardly through the opening 39, followed by twisting or rotating pin 34 on its axis to lock the lug 38 against the interior of the end wall 31, as shown in FIGS. 5 and 7.

By virtue of this arrangement, the guide pin cartridge assembly 24 and the similar upper pivot pin cartridge assembly 22 can be installed as a unit with the pin 34 retracted in the housing 26. After insertion of the assembly in the door panel, as will be further described, manual twisting of the pin 34 in the opposite direction to align the locking lug 38 with the opening 39 allows the spring 35 to thrust the pin 34 and cap 25 to the active use position shown in phantom lines in FIG. 5 and also shown in FIG. 3. This is a major convenience feature over the prior art in the process of installing the assemblies 24 and 22.

Another important feature of the invention common to the assemblies 24, 22 and 23 is the provision on the wall 28 of housing 26 immediately inwardly of the enlarged head 29 of an integral resilient locking tang 40. This identical tang 40 on the assembly 22 is also clearly shown in FIG. 6, and the construction and operation of this element in the three assemblies 24, 22 and 23 is identical, as stated.

Figure 3:
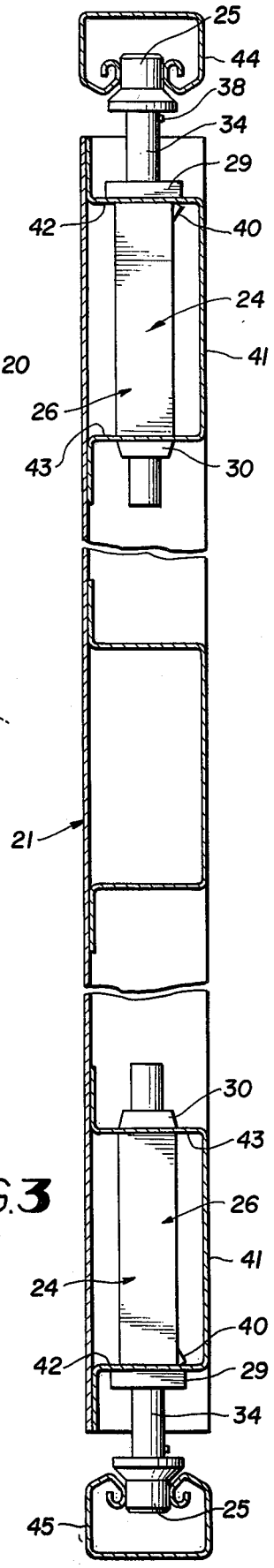
FIG. 3 is an enlarged fragmentary vertical section taken on line 3—3 of FIG. 1 and showing top and bottom door guide pin cartridge assemblies according to the invention.

In connection with the top and bottom guide pin cartridge assemblies 24 shown in FIG. 3 after assembly with the sliding panel 21 of a bifold door, top and bottom hat cross section braces 41 of the door panel 21 have coaxial square apertures formed therethrough to allow easy insertion of the housings 26 downwardly and upwardly on the door panel to their assembled and securely locked positions, FIG. 3. The resilient locking tangs 40 yield inwardly and pass through the openings in the top and bottom walls of the braces 41 and then snap outwardly under and above these walls 42 to snap lock the assemblies 24 securely in place with the heads 29 of housings 26 abutting the walls 42 and the tapered ends 30 projecting through the far walls 43 of the braces 41. In this manner, the entire assembly 24 is firmly held on the brace member 41 of the sliding door panel 21, but can be removed if this is ever desired by depressing the tang 40 with a screwdriver.

Following insertion and snap locking of each assembly 24 in the above-described manner, the installer merely rotates the pin 30, as already described, to align the lug 38 with opening 39, thus allowing the spring 35 to project the pin 34 and cap 25 to the use position shown at the top and bottom of FIG. 3. In such position, each cap 25 guidingly engages an overhead or bottom door guide track 44 or 45, as illustrated. No adjustment of the guide pin cartridge assembly 24 is provided for and none is necessary. The proper height adjustment of the folding door is made through the assembly 23, now to be described. After such height adjustment, it is only necessary to insert and snap lock the assemblies 24 on the sliding door panel and release the spring tension, as described, and the guide pin assembly is ready for use. The identical simple installation of the top pivot pin cartridge assembly 22, FIG. 4, is made possible by the invention. When the assembly 22 is installed and its spring tension released in the described manner, the top end portion of the top pivot pin 34 is received in an overhead fixed pivot bearing 46 held within the track 44 in a conventional manner.

The bottom adjustable pivot pin cartridge assembly 23 comprises a molded nylon housing 47 of rectangular cross section like the housing 26 and having basically the same outside dimensions so as to be insertable in a rectangular opening of the lower brace member 48 on the pivotal door panel 20 of each bifold door. Like the housing 26, the housing 47 has the already-described snap locking tang 40 near its enlarged head 49 which is arranged lowermost during use, FIG. 4, in abutment with the bottom web 50 of brace member 48. The far end of the molded housing 49 is slightly recessed on two side faces as at 51, FIG. 6, to receive two parallel legs 52 of a U-shaped lock clip or nut 53 which in effect straddles the adjacent end portion of the housing 47. The legs 52 have in-struck tangs 54 which snap lock into detents 55 formed in the opposite sides of the housing 47 near one end. A transverse end wall 56 of the lock clip 53 has a central threaded opening 57 which threadably receives an adjustable screw-threaded pivot pin 58 having a screwdriver slot 59 in one end and a smooth cylindrical pivot extension 60 at its other end for the reception during use in a bearing 61 of bottom track 45, FIG. 4. The lock clip 53 is of the same width as the housing 47 in two coordinate directions and thus is insertable with the rectangular housing as a unit upwardly through the rectangular openings of the brace member 48. It can be noted in FIG. 4 that the upper web 62 receives the lock clip 53 within its opening and thus lateral forces are directed to the hardened steel lock clip and not directly to the nylon housing 48 and this is a strength and durability feature of the invention. The tang 40 serves to lock the assembly 23 in place on the door panel 20 securely in the manner already described for the two assemblies 24 and 22.

As best shown in FIGS. 6 and 9, the housing 47 is internally screw-threaded at the head 49 as indicated at 63. It is also screw-threaded at its far end portion adjacent the lock clip 53, as at 64, and between these two locations, the housing is further internally threaded at longitudinally staggered cross bars 65, 66, 67, 68 and 69 on opposite sides of the housing. Collectively, these internally threaded portions of the molded nylon housing 47 provide more than one and one-half inch of full threads along the axis of the threaded pin 58 for security plus the threaded connection with the lock clip 53 which in effect is a nut.

A cooperating lock nut 70 is provided on the assembly for locking abutment against the end face of steel lock clip 53 following adjustment of the pin 58 relative to the remainder of the assembly. The height adjustment of each bifold door is properly attained through adjustment with a screwdriver of the threaded pin 58 on assembly 23, followed by tightening of the lock nut 70 with the assembly arranged as in FIG. 4.

As in the case of assembly 22 and 24, the bottom pivot pin cartridge assembly 23 is insertable as a unit and can be removed if this is ever necessary. The double thread lock arrangement prevents the threaded pin 58 from ever loosening during use and the hardened steel lock clip 53 adds strength, as described.

It should now be apparent that the three similar assemblies 24, 22 and 23 provide full pivotal and guiding support for each pair of panels 20 and 21 forming the bifold door. Factory fabrication of the doors is rendered less expensive and installation on the job site is rendered simpler and more convenient. In these aspects, the invention is a significant advance over the prior art.

One other feature of the invention is that all bifold doors are non-handed as shipped from the factory and stocked in a customer warehouse. Only at installation does the door become either right or left handed by virtue of the way in which the handle 71 is attached to the pivot panel 20 of the door assembly. It is believed that the advantages of the invention over the prior art should now be apparent to those skilled in the art without the necessity for any further description herein.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. In a folding door structure including a pair of door sections hingedly connected on a vertical hinge axis and disposed between overhead and bottom guide tracks for horizontal movement between folded and unfolded positions, each folding door section having upper and lower braces and each brace including a pair of vertically spaced horizontal walls, the improvement comprising a prefabricated and preassembled unitized guide pin cartridge assembly for installation on the job site where the folding door structure is being installed on said upper and lower braces of one door section and on the upper brace of the other door section of said pair, and a coacting prefabricated and preassembled unitized and adjustable pivot pin cartridge for installation on said job site on the lower brace of said other door section, all of said guide and pivot pin cartridge assemblies including rectangular cross section pin housings having enlarged heads at one end and cooperating yielding locking tangs projecting from one side thereof near said head, whereby said housings may enter rectangular openings in said vertically spaced horizontal walls of said upper and lower braces with the heads of the housings abutting the outer faces of corresponding walls and said locking tangs lockingly engaged with the opposite faces of said walls of the braces, upper and lower guide track follower elements on the pins of sid guide pin cartridge assemblies, and a pivot extension on the pin of said adjustable pivot pin cartridge assembly, and said rectangular cross section pin housings serving to enclose major portions of the lengths of the guide and pivot pins of said cartridge assemblies along at least two opposite sides thereof.

2. In a folding door structure as defined in claim 1, and releasable spring-urged detent means for the pin element of each guide pin cartridge assembly enabling retraction of such pin element prior to installation of the guide pin cartridge assemblies on said door sections and following height adjustment of the door sections by means of said pivot pin cartridge assembly.

3. In a folding door structure as defined in claim 1, and the pin element of said adjustable pivot pin cartridge assembly being screw-threaded, and the housing of such assembly being internally threaded at least for a part of the length of the housing to receive adjustably the screw-threads of the pin element, and thread locking means on said pivot pin cartridge assembly whereby such assembly will remain in a selected adjusted position.

4. In a folding door structure as defined in claim 2, and the pin element of said adjustable pivot pin cartridge assembly being screw-threaded, and the housing of such assembly being interally threaded at least for a part of the length of the housing to receive adjustably the screw-threads of the pin element, and thread locking means on said pivot pin cartridge assembly whereby such assembly will remain in a selected adjusted position.

5. In a folding door structure as defined in claim 1, and said housings being molded from plastics material, said yielding locking tangs being formed integrally on the molded housings.

* * * * *